US007762216B1

(12) United States Patent
Pope

(10) Patent No.: US 7,762,216 B1
(45) Date of Patent: Jul. 27, 2010

(54) WOOD FIRED HOT WATER HEATING SYSTEM

(76) Inventor: William T. Pope, 105 Pine St., Lucama, NC (US) 27851

( * ) Notice: Subject to any disclaimer, the term of this patent is extended or adjusted under 35 U.S.C. 154(b) by 605 days.

(21) Appl. No.: 11/563,452

(22) Filed: Nov. 27, 2006

(51) Int. Cl.
*F24H 1/00* (2006.01)

(52) U.S. Cl. ..... 122/16.1; 122/30; 237/19

(58) Field of Classification Search ..... 122/16.1, 122/20 A, 30, 33; 220/560.04; 237/1 R, 237/28, 19
See application file for complete search history.

(56) References Cited

U.S. PATENT DOCUMENTS 4,418,649 A * 12/1983 Purvis ..... 122/16.1
4,471,724 A * 9/1984 Pope ..... 122/16.1
4,471,751 A * 9/1984 Hottenroth et al. ..... 126/25 R
4,968,008 A * 11/1990 Emmett et al. ..... 266/168

* cited by examiner

*Primary Examiner*—Gregory A Wilson
(74) *Attorney, Agent, or Firm*—Coats & Bennett, P.L.L.C.

(57) ABSTRACT

A hot water heating system is provided for heating water that is utilized to heat a structure such as a tobacco barn. The hot water heating system includes a base and a vessel, movably mounted on the base, for holding water supported on the base. The vessel is movable back and forth on the base between a heating position and a loading position. In the heating position, the vessel overlies a fire chamber. When the vessel moves to the loading position, the fire chamber is open at the top so as to permit solid fuel, such as wood, to be loaded through the open top of the fire chamber.

22 Claims, 9 Drawing Sheets

WOOD FIRED HOT WATER HEATING SYSTEM

BACKGROUND OF THE INVENTION

Businesses that utilize substantial quantities of petroleum fuels such as heating oil and gas must contend with the high cost of such fuels and the wide price fluctuations that are typically experienced. For the most part, these businesses have little or no control over the cost of petroleum fuels. A number of factors contribute to this problem. First, geopolitics throughout the world has a tremendous influence on the price of petroleum fuels, and in some cases, its availability. Severe weather conditions can also impact the cost of petroleum fuels. Moreover, the continued consumption of petroleum fuels reduce the amounts of petroleum that can be economically recovered, and with the growing demands for oil by countries such as China and India, the price and availability of conventional petroleum fuels such as oil and gas is uncertain.

The cost of conventional petroleum fuel has caused oil-consuming businesses to look at alternative approaches. For example, it is known to use wood to cure and dry tobacco. In the case of curing and drying tobacco, it is known to burn wood to heat water in a water tank, and the hot water is directed to heat exchangers that effectively heat air used in curing and drying the tobacco. However, one of the major problems with utilizing wood, for example, is the time and effort required to repeatedly load the fire chamber.

Wood is a readily available fuel source in many locations. In some cases there is an opportunity to utilize wood that is unsuitable for being processed at sawmills or other processing facilities because the wood includes nails, steel spikes, and other foreign structures. In many cases, wood unsuitable for conventional processes can be procured in a very cost-effective manner. In these cases, wood is even more economical than conventional petroleum fuels.

SUMMARY OF THE INVENTION

The present invention relates to a hot water heating system comprising a vessel for holding water where the vessel is movably mounted on a base between a heating position and a loading position. A fire chamber is disposed under the vessel when the vessel assumes the heating position. When the vessel assumes the loading position, the fire chamber is open at the top and permits the loading of solid fuel through the open top of the fire chamber.

In addition, in one embodiment, the hot water heating system includes a plurality of rollers that support the vessel on the base and permit the vessel to move back and forth between the heating position and the loading position. The hot water heating system is configured in the area of the rollers to provide an air flow across the rollers so as to cool the rollers. In addition, in one embodiment the air passing over the rollers for cooling purposes is also directed inwardly into the fire chamber to aid in the combustion process that takes place in the fire chamber.

In another embodiment, the hot water heating system includes a pair of spaced apart, longitudinal side frames that support a series of longitudinally spaced trusses that span the side frames and rest on the side frames.

Other objects and advantages of the present invention will become apparent and obvious from a study of the following description and the accompanying drawings which are merely illustrative of such invention.

DESCRIPTION OF THE INVENTION

Figure 1:
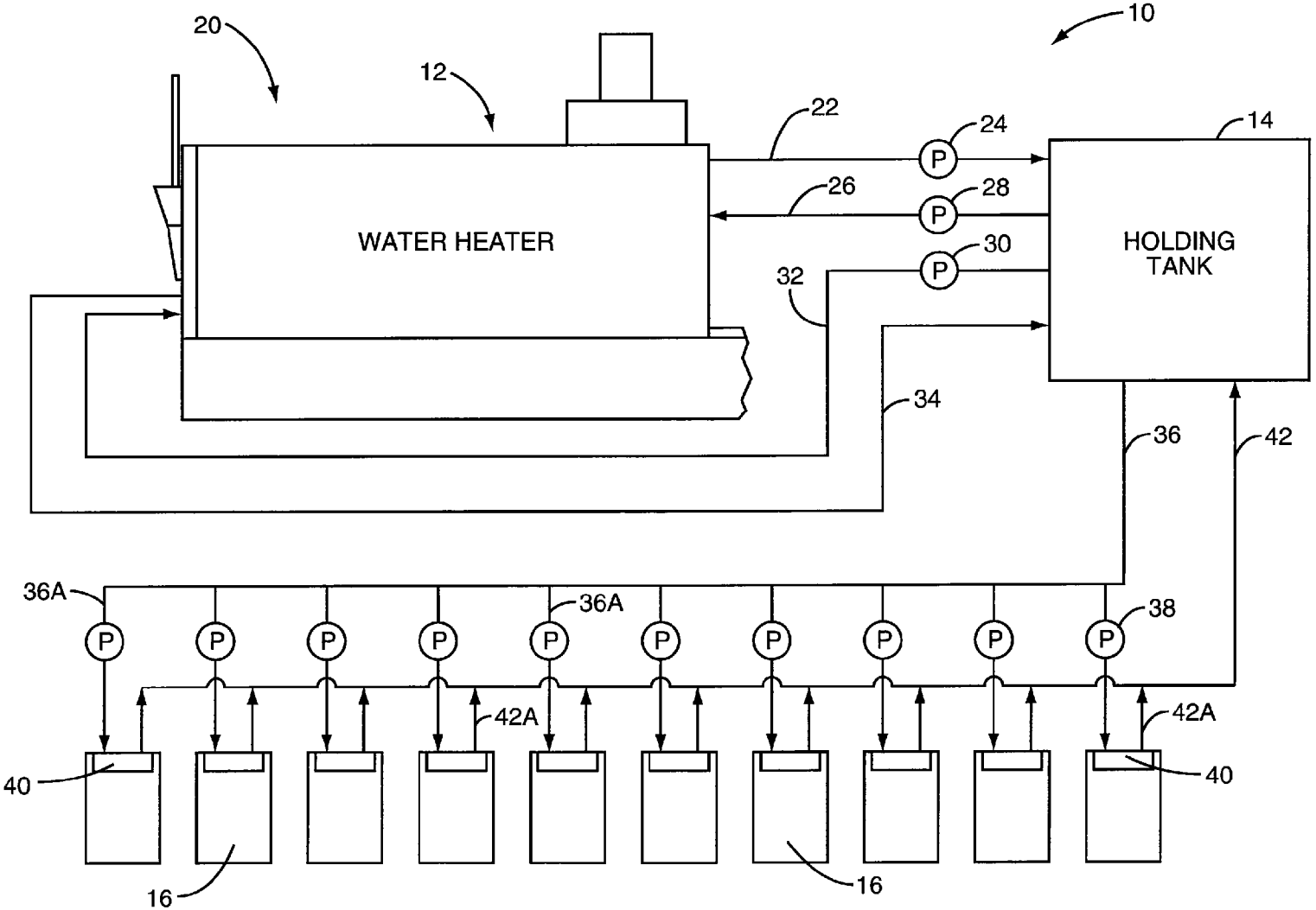
FIG. 1 is a schematic illustration of the hot water heating system of the present invention.

With further reference to the drawings, particularly FIG. 1, a heating system is shown therein and indicated generally by the numeral 10. Heating system 10 includes a hot water heating system 12, a holding tank 14 and a series of structures 16, which in the case of the embodiment illustrated herein, is a series of tobacco barns. It is appreciated that the heating system 10 of the present invention can be utilized to provide a heat source for heating various structures such as greenhouses, dryers, and other structures as well. In addition, hot water produced by the heating system 10 can be utilized as a heating medium for transferring heat to any heat consuming component or element.

Forming a part of the hot water heating system 12 is a vessel indicated generally by the numeral 20. Vessel 20 holds water, and as will be described subsequently herein, is movable back and forth between a heating position (FIG. 2) and a loading position (FIG. 2A). In the heating position vessel 20 overlies a fire chamber that burns a solid fuel such as wood. In the loading or retracted position, the fire chamber is open at the top and solid fuel, such as wood, can be loaded through the top into the fire chamber. In any event, hot water is produced in the vessel 20 and is circulated back and forth between the holding tank 14. As schematically illustrated in FIG. 1, there is provided a hot water outlet line 22 that extends between the vessel 20 and the holding tank 14. A pump 24 communicatively connected to line 22 pumps hot water from the vessel 20 into the holding tank 14. Because hot water is continuously circulated between the holding tank 14 and the vessel 20, there is provided a return line 26 extending between the holding tank 14 and the vessel. Communicatively connected with return line 26 is a pump 28 for pumping the hot water from the holding tank 14 to the vessel 20.

As will be described in greater detail subsequently herein, a pair of openable doors encloses a portion of the fire chamber. Each door includes a water jacket and water is circulated between each door and the holding tank 14. For each door there is a pump 30 that pumps water from the holding tank 14 to the door via line 32. Hot water is pumped from each door via an outlet or return line 34 back to the holding tank 14.

Schematically shown in FIG. 1 is the series of structures 16. A main feed line 36 extends from a holding tank 14 and is communicatively connected to a series of branch lines 36A that are directed to a series of pumps 38. Each pump 38 is operative to pump hot water from a respective branch line 36A to and through a heat exchanger 40. Each heat exchanger 40 is operative to heat the structure 16, which in the case of the embodiment illustrated herein, is a tobacco barn. Extending from the respective heat exchangers 40 is a series of branch return lines 42A. Each branch return line 42A joins a main return line 42 that extends back to the holding tank 14. Therefore, it is appreciated that hot water heating system 12 heats water contained in the vessel 20, and the heated water is pumped to the holding tank 14. From the holding tank 14 the heated water is pumped to the series of heat exchangers 40 that supply heat to the respective structures or to heat consuming mediums. Details of the heat exchangers 40 are not dealt with herein because such is not per se material to the present invention, and because conventional heat exchangers suitable for the type of application illustrated in FIG. 1 are well known and appreciated by those skilled in the art.

Figure 2:
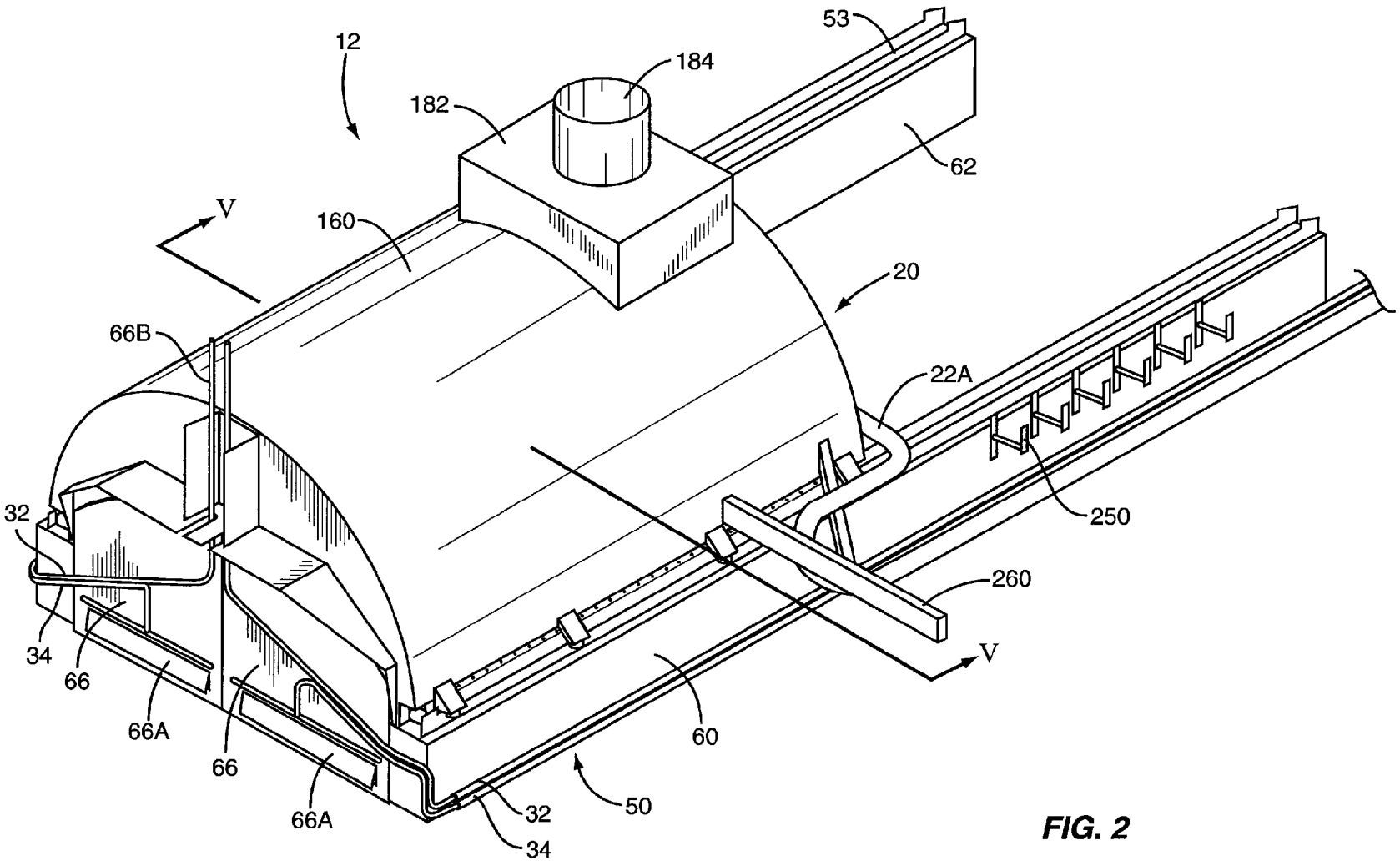
FIG. 2 is a perspective view of the vessel of the hot water heating system of the present invention with the vessel shown in the heating position.
Figure 2A:
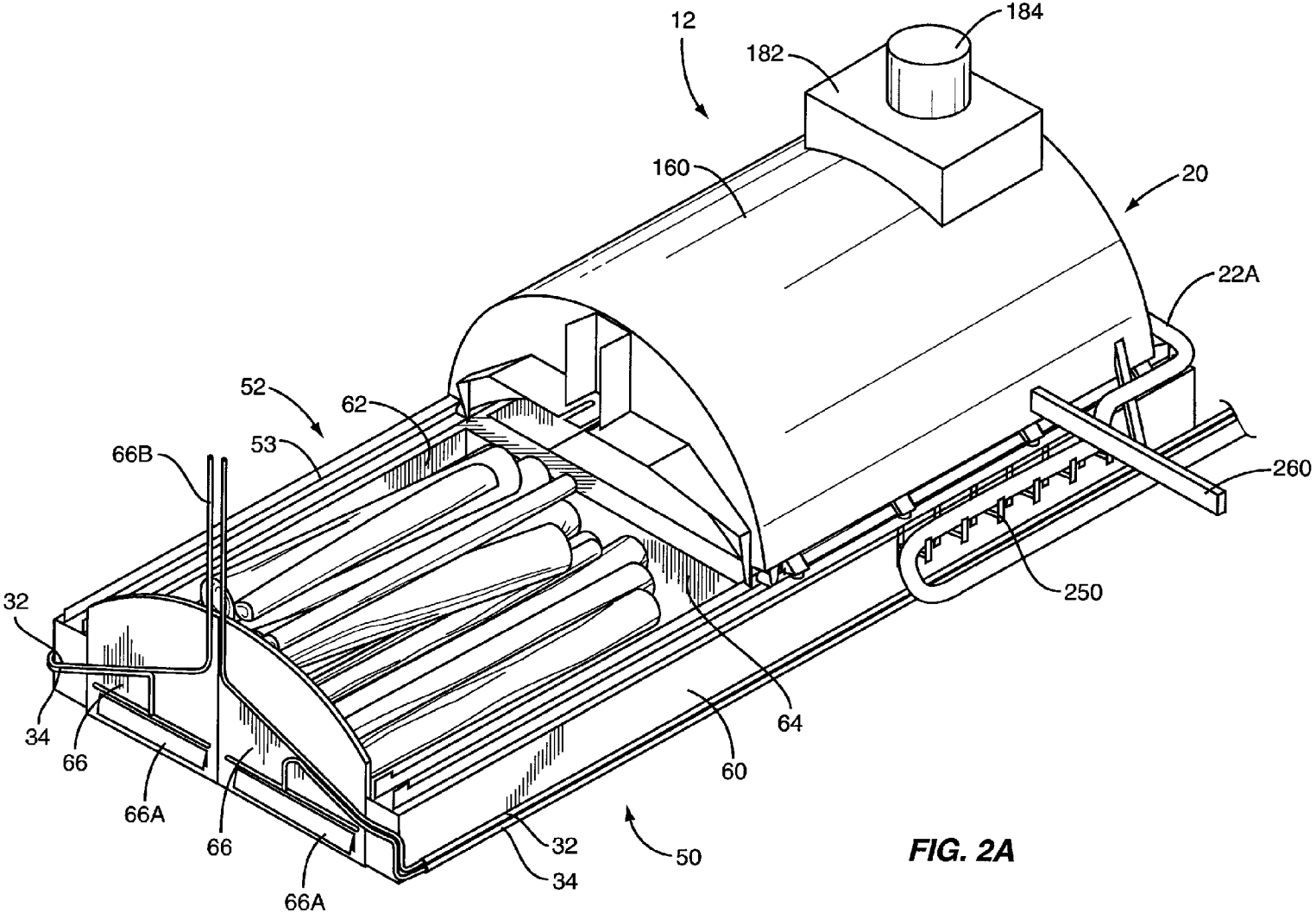
FIG. 2A is a perspective view similar to FIG. 2, but with the vessel disposed in the loading position.

Turning to FIGS. 2 through 8, the hot water heating system 12 is shown therein. Hot water system 12 includes a base indicated generally by the numeral 50. Supported on the base is the vessel 20. Vessel 20 is movable back and forth between the heating position and a retracted or loading position. The heating position is illustrated in FIG. 2, and the retracted or loading position is illustrated in FIG. 2A. In the case of the embodiment illustrated in FIGS. 2-8, the base includes a pair of spaced apart concrete walls 60 and 62. Disposed between the concrete walls 60 and 62 is a fire chamber indicated generally by the numeral 52. Fire chamber 52 is disposed underneath the vessel 20 when the vessel assumes the heating position (FIG. 2).

Figure 6:
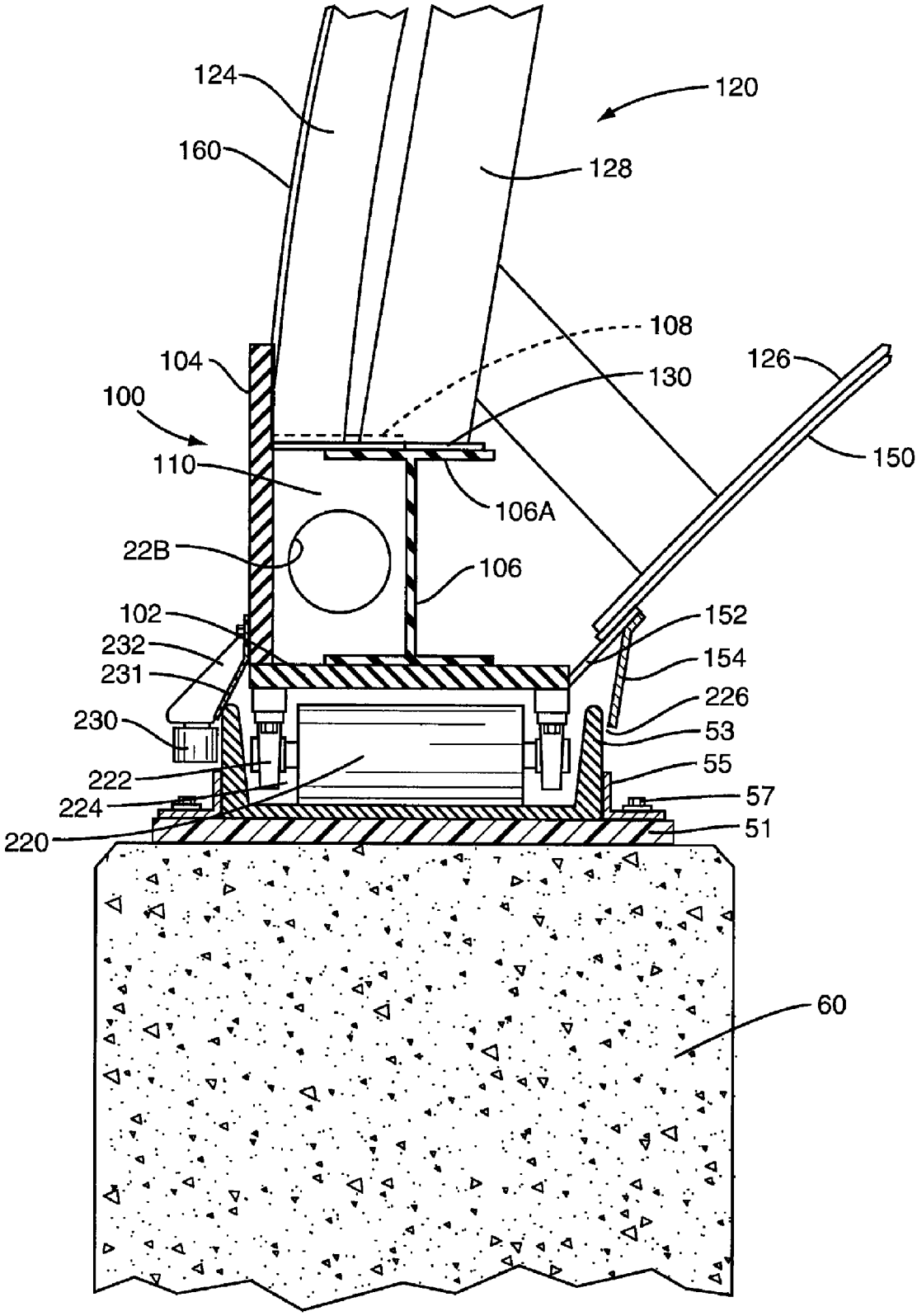
FIG. 6 is an enlarged fragmentary sectional view showing a portion of the vessel supported on a concrete wall.

With reference to FIG. 6, secured to the top of each concrete wall 60 is a base plate 51. To assure that plate 51 is installed in a level orientation, the upper surface of walls 60 and 62 can be finished with a grout layer (not shown) or other suitable material. Thus, when plate 51 is installed, the plate will be supported in a level configuration. Secured or disposed over the base plate is an elongated steel channel 53 that includes a web and opposed flanges. A retaining rail 55 is secured to the base plate 51 by bolt assemblies 57. Retaining rails 55 retain and confine the channel 53 on the base plate 51.

Fire chamber 52 is designed to hold a solid fuel such as wood. See FIG. 5. Other types of solid woods such as coal, trash, debris, etc. can be utilized in the fire chamber 52. Fire chamber 52 is bounded or defined by a series of structures. First, the concrete walls 60 and 62 define a portion of the fire chamber. A back wall 64 extends across a back portion of the hot water heating system 12 and forms a rear wall of the fire chamber 52. About the front of the fire chamber 52 is a pair of openable doors 66. When doors 66 are closed and the vessel 20 assumes the heating position, the doors effectively close a front portion of the fire chamber. In addition, when the vessel 50 assumes the heating position, such as shown in FIG. 2, the bottom of the vessel forms the top or ceiling of the fire chamber 52. In one embodiment, the bottom of the fire chamber 52 is simply the ground 68.

Each door 66 includes a vent that enables air utilized in the combustion process to be introduced into the fire chamber 52. In the case of the embodiment illustrated herein, each door 66 includes an adjustable damper 66A that can be opened, closed or whose position can be varied to adjust the quantity of air induced into the fire chamber 52. Furthermore, each door 66 includes spaced apart front and rear walls that form a water jacket for holding water. As discussed above in the context of FIG. 1, a pair of water lines 32 and 34 lead to and from each door 66 such that water can be pumped and circulated between the holding tank 14 and each door 66. Extending upwardly from each door is a vent tube 66B that functions to permit steam to be exhausted therefrom in the event that the water contained in the doors 66 is overheated.

Turning now to the vessel 20, and particularly FIG. 6, the vessel includes a pair of longitudinal side frames with each side frame being indicated generally by the numeral 100. Each side frame 100 extends longitudinally about the outer lower side of the vessel 20 and extends from the front to the back of the vessel. Viewing FIG. 6, each longitudinal side frame 100 includes a base plate 102 and a vertical plate 104. Base plate 102 is secured by weldment or other suitable means to vertical plate 104. In the embodiment illustrated herein, base plate 102 and vertical plate 104 form a generally 90° angle. Welded to the base plate 102 is an I-beam 106. Note that I-beam 106 sets interiorly of vertical plate 104. Forming a part of the I-beam 106 is a support plate 106A. A series of flat bars 108 extend between the vertical plate 104 and the support plate 106A. Bars 108 are spaced apart such that openings are provided between the respective bars. This structure, that is base plate 102, vertical plate 104, I-beam 106 and bars 108, forms an elongated channel along the lower outer portions of the vessel 20. This channel is generally closed except for the openings that are formed in the top of the channel, and particularly between the spaced apart bars 108.

Figure 4:
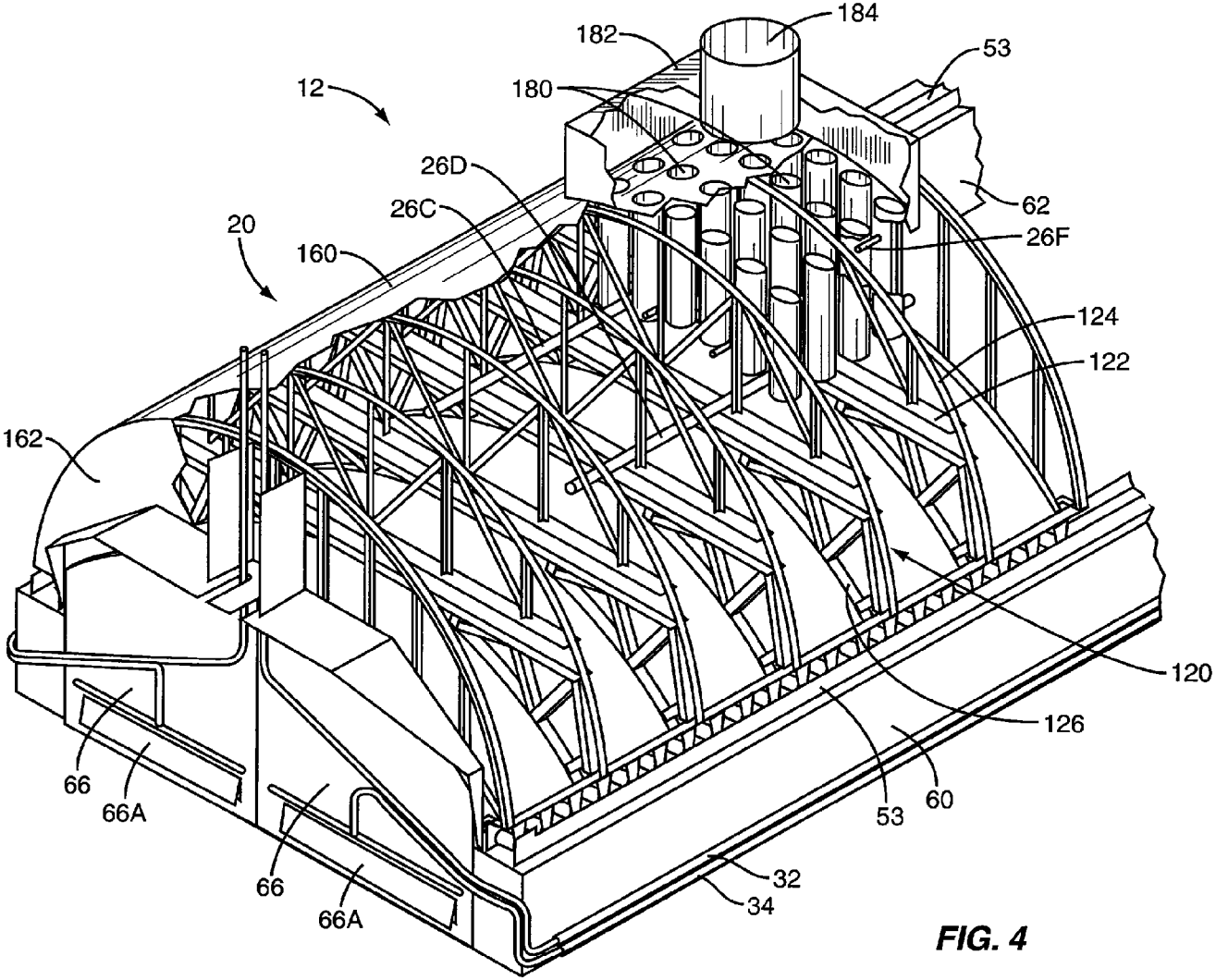
FIG. 4 is a perspective view of the vessel with portions broken away to better illustrate structural components of the vessel.
Figure 5:
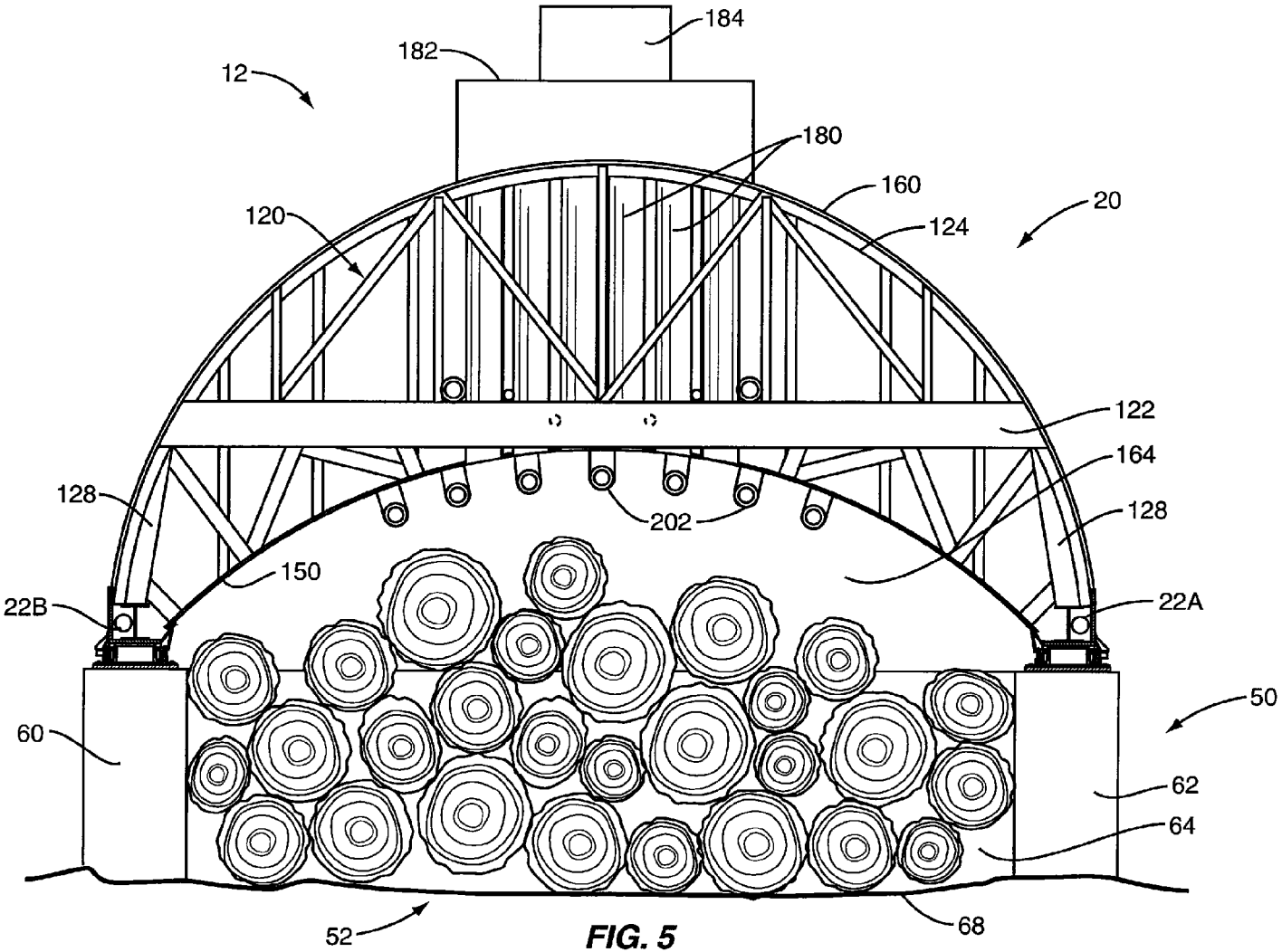
FIG. 5 is a cross sectional view of the vessel taken along the line V-V of FIG. 2.

To structurally support the vessel, there is provided a series of longitudinally spaced trusses, indicated generally by the numeral 120, that extend through the interior of the vessel. As illustrated in FIG. 5, each truss 120 includes an arcuate shaped bottom and an arcuate shaped top. More particularly, each truss 120 includes an upper arcuate band 124 and a lower arcuate band 126. See FIGS. 4 and 5. In addition, each truss includes a main horizontal beam 122. Various vertical and horizontal structural members interconnect the upper band 124, lower band 126 and main horizontal beam 122. Note in FIGS. 5 and 6 where each truss includes a side reinforcing member 128 that extends upwardly and joins upper band 124. As further shown in FIG. 6, secured to the lower ends of the band 124 and side reinforcing member 128 is a horizontal plate 130. Each end of a respective truss 120 is supported by the longitudinal side frame 100. More particularly, as illustrated in FIG. 6, plate 130 formed on the lower outer portion of each truss 120 sits on the I-beam 106 and is welded or otherwise secured thereto. The upper band 124 extends downwardly and fits flush or closely adjacent the inside surface of vertical plate 104. Thus, it is seen that each truss 120 is supported about extreme end portions by the longitudinal side frames 100.

A bottom 150 is secured to the lower bands 126 of the respective trusses 120. Note that bottom 150 assumes an arcuate shape, and more particularly, assumes a concave shape with respect to the underlying fire chamber 52. As illustrated in FIG. 6, bottom 150 joins an extension 152 that connects to plate 102. An elongated rigid plate or flap 154 is secured to the extension 152 and depends downwardly therefrom and forms an opening 226 between rail 53 and the rigid plate. A heavy weld secures plate 154 to extension 152. Because plate 154 faces the fire chamber 52 it is subjected to substantial heat and tends to be hot. However, the connection of plate 154 with extension 152 permits heat to be readily transferred from plate 154 to the extension since the extension forms a part of the structure of the vessel. By transferring heat from plate 154, the spacing of gap or opening 226 can be maintained generally constant. Likewise, the vessel 20 includes an arcuate shaped top 160. Arcuate shaped top 160 is secured to the upper bands 124 of the respective trusses 120. Enclosing the vessel 20 is a front wall 162 and a back wall 164. Although not shown in detail, the structures that make up the vessels 20 are secured together so as to form a generally watertight tank or container for holding water.

To exhaust gases from the fire chamber 52, there is provided a series of pipes or conduits 180 that extend upwardly through the vessel 20. As illustrated in FIGS. 4 and 5, each of the pipes 180 extends from the bottom 150 to the top 160 of vessel 20. That is, each pipe 180 is open at the bottom 150 to the fire chamber 52. Upper ends of the pipes 180 terminate at the top 160 and within a plenum 182 that effectively channels exhaust gases out a main exhaust 184. Thus, it is appreciated that water contained within the vessel 20 surrounds the respective pipes 180. Hence, heat associated with the exhaust gases moving upwardly through the pipes 180 can be transferred to water contained in the vessel 20.

Secured to the bottom 150 of the vessel 20 is a series of wet tubes indicated generally by the numeral 200. Wet tubes 200 include a series of generally U-shaped tubes 202 that extend or project downwardly from the bottom 150 and permit water within the vessel 20 to circulate there through. See FIGS. 7 and 8.

Figure 7:
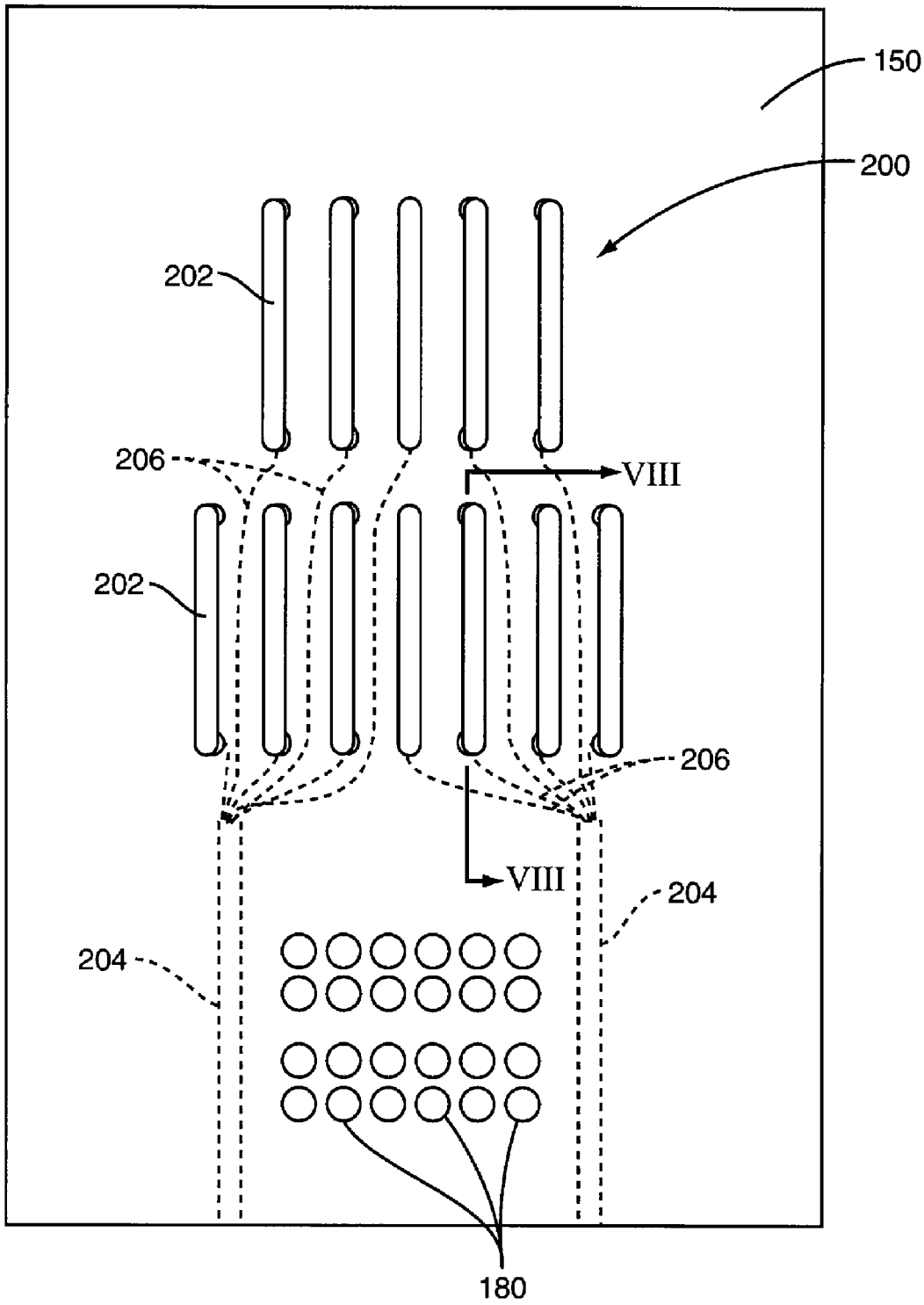
FIG. 7 is a plan view of the bottom of the vessel and particularly illustrates a series of wet tubes depending from the bottom.
Figure 8:
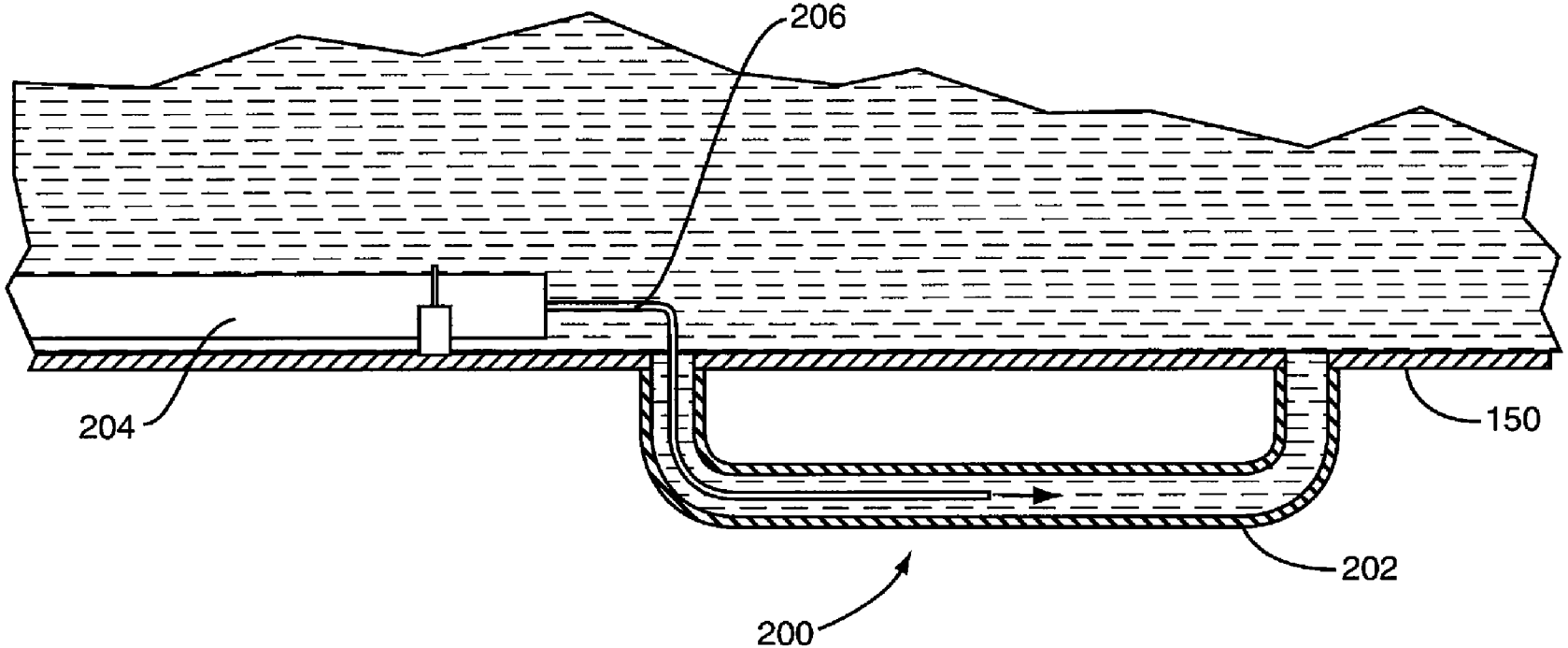
FIG. 8 is a fragmentary sectional view taken through the line VIII-VIII of FIG. 7.

While bottom 150 of vessel 20 assumes a generally arcuate shape, it has been noticed that substantial heat is applied to the bottom 150 in a generally intermediate central area of the bottom. Thus, in the case of the embodiment illustrated herein, the respective wet tubes 202 are strategically placed in relatively hot areas. Thus, as illustrated in FIG. 7, the respective wet tubes 202 are disposed between the exhaust tubes 180 and the front of the vessel 20 with the wet tubes being spaced a short distance from the front wall 162. To encourage or facilitate the circulation of water through tubes 202, there is provided a pair of main feed lines 204. One feed line 204 is illustrated in FIG. 8. This feed line is operatively connected to an inlet supply of water from the holding tank 14. At one end of the main feed line 204 there is provided an end cap having a series of openings therein with each opening being connected to a tube feed line 206. See FIG. 8. Thus, a series of tube feed lines 206 would extend from each main feed line 204 with each tube feed line extending at least partially through a wet tube 202. Water exhausted or expelled by the respective tube feed lines 206 encourage the circulation of water through the wet tubes 202. Again, because the wet tubes 202 are disposed in relatively hot areas on or adjacent the bottom 150, it is appreciated that efficient heat transfer with water circulating through the wet tubes 202 is accomplished.

As has been discussed before, vessel 20 is movable back and forth on the concrete walls 60 and 62 between a heating position and a loading position. In order to facilitate the movement of the vessel 20, the vessel is provided with a series of rollers 220. This is particularly shown in FIG. 6. Each roller 220 is supported by a pair of bearing assemblies 222. Note that the bearing assemblies 222 are secured to plate 102 and depend therefrom. Rollers 220 extend transversely between the bearing assemblies 222 and engage the web of channel 53.

The structure surrounding each set of the rollers 220 forms a longitudinal air cooling channel 224. That is, the U-shaped channel 53, along with plate 102, forms an elongated channel that permits air to flow there through so as to cool rollers 220 and the bearing assemblies 222. Because the longitudinal cooling channels 224 are generally opened on the front and rear ends of the vessel 20, it is postulated that air will enter the ends of the longitudinal cooling channels 224 and flow longitudinally over the rollers 220 and bearing assemblies 222, cooling them in the process. In addition, it is postulated that air will be induced through the longitudinal cooling channels 224 due to the natural draft that is occurring in the fire chamber 52. That is, during the course of burning a solid fuel, such as wood, in the fire chamber 52, it is appreciated that air will be introduced into the fire chamber through dampers 66A formed in the doors 66. This induced air will move longitudinally through the fire chamber and the solid fuel therein will be exhausted out the exhaust tubes 180. Hence, it is postulated that air moving in the longitudinal cooling channels 224, or in the vicinity of the rollers 220, will be induced inwardly into the fire chamber 52. Note in FIG. 6 where there is provided opening 226 between flap 154 and a flange of the U-shaped channel 53. Opening 226 enables air found in the vicinity of the rollers 220 to be induced inwardly into the fire chamber 52 and will act to enhance combustion, which may be termed supplemental combustion. This will aid in the combustion process and make the combustion that occurs in the fire chamber 52 more complete and in that manner, will result in the exhaust gases exiting the vessel being cleaner.

To maintain alignment of the vessel 20 with the guide channel 53, each side frame 100 is provided with a series of rollers 230 that are designed to engage the outer flange of the guide channel 53. See FIG. 3. Note that the respective rollers 230 are rotatively mounted about vertical axes and are secured to a series of arms 232 that are in turn secured to the vertical plate 104 and depend downwardly therefrom at a slight angle. Rollers 230 disposed on both sides of the vessel 20 will generally maintain the rollers 220 in proper alignment with the channel 53 and permit the rollers 220 and the respective side frames 100 to move back and forth without any portion of the vessel structure experiencing interference. Furthermore, rollers 230 function to maintain the opening 226 that lies between plate 154 and the inner flange of channel 53.

A series of flaps 231 extend along an outer portion of each cooling channel 224. See FIG. 6. These flaps are secured end-to-end and are bolted to the vertical plate 104 and depend downwardly therefrom where a lower edge extends over the outer flange of channel 53. In the position shown in FIG. 6, flaps 231 close the outer side of each cooling channel 224. However, any one of the plurality of flaps 231 can be opened or adjusted to permit an air gap between the flap and the outer flange of channel 53. For example, the front most flap 231 can be open or complete removed, creating an open air gap along the front outer side of the adjacent cooling channel 224. This will permit air to move into the air gap, through the cooling channel 224 and into the fire chamber 52 via opening 226. Thus, the rate of combustion can be controlled by adjusting the respective flaps 231 along each side of the vessel.

Figure 3:
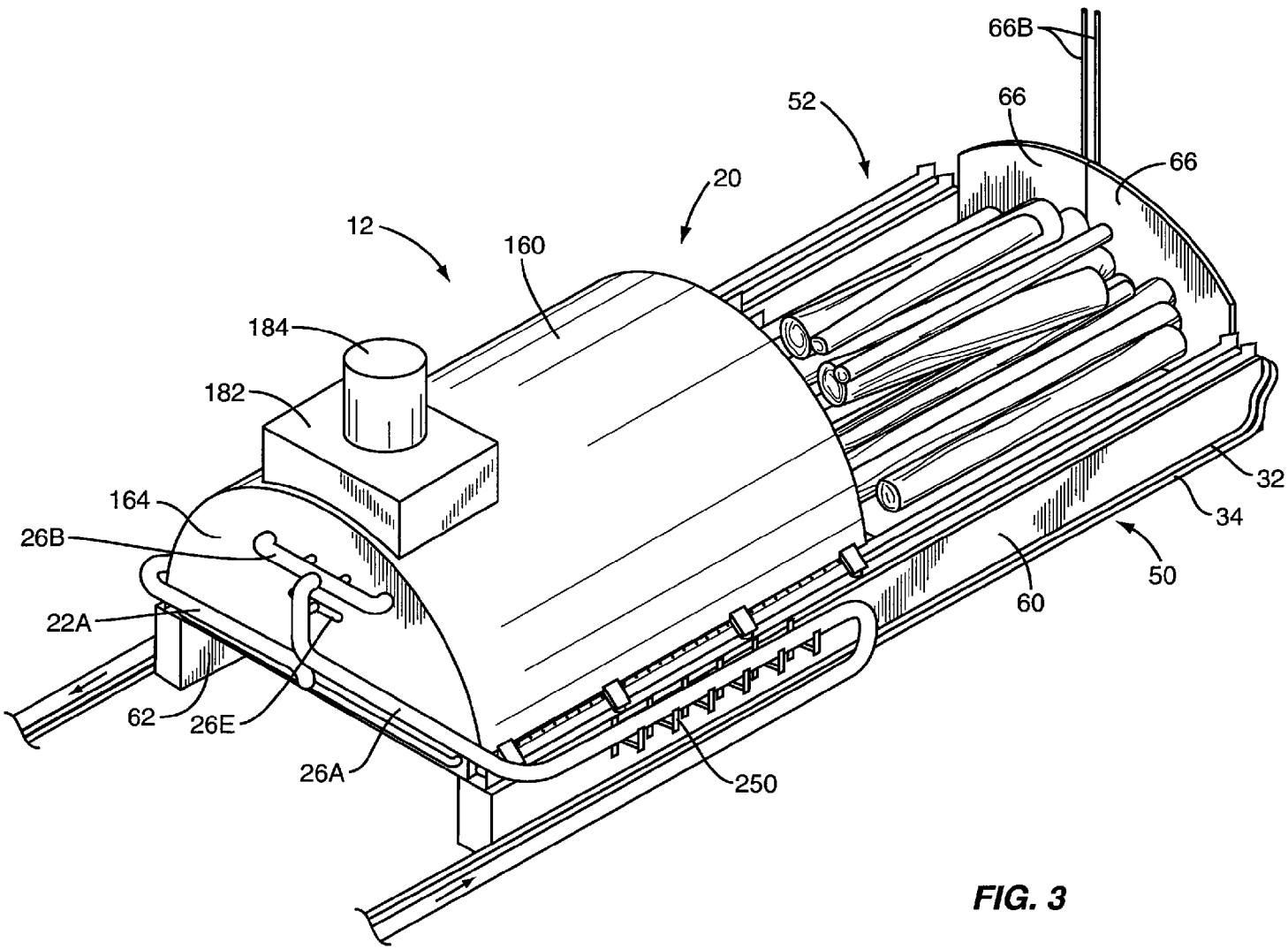
FIG. 3 is a perspective view of the vessel of the hot water heating system, in the loading position, as viewed from the back and one side.

As discussed above with respect to FIG. 1, hot water is circulated back and forth between the vessel 20 and holding tank 14. As shown in FIG. 1, an inlet line 26 channels water from the holding tank 14 to the vessel 20. Inlet line 26 includes a flexible end 26A. This is shown in FIG. 3. Flexible end 26A tees into an exterior supply line 26B that lies adjacent the back wall 164 of the vessel 20. Exterior supply line 26B communicates with a pair of interior conduits or pipes 26C and 26D. See FIG. 4. Note that interior pipes or conduits 26C and 26D extend from the back wall 164 forwardly to an intermediate area within the vessel 20. As seen in FIGS. 4 and 5, the interior conduits 26C and 26D are supported on the horizontal beams 122 of the respective trusses 120. Each interior conduit 26C and 26D includes an outlet end for discharging water into the vessel.

In addition, some inlet water being directed into the vessel 120 is discharged in close proximity to the exhaust conduits or pipes 180. Note that flexible line 26A also tees into an exterior supply line 26E. Exterior supply line 26E is communicatively coupled or forms a part of one or more stud pipes or conduit 26F that include outlet ends that are disposed in close proximity to the exhaust pipes 180. See FIG. 4. One or more stud pipes or conduits 26F can be dispersed in and around the various exhaust conduits 180 to discharge water recirculated from the holding tank 14 into an area in close vicinity to the exhaust tubes or conduits 180. Flexible line 26A also provides inlet water to the main feed lines 204 that feed the respective lines 206 that extend through the wet tubes 202.

In similar fashion, the outlet line 22 includes a flexible outlet end 22A that is communicatively connected to the vessel 20. This is illustrated in FIGS. 2 and 3. The flexible outlet line 22A is communicatively connected to a pair of outlets 22B. Note in FIG. 6 where each outlet 22B is formed in a rear portion of the vessel 20 and aligned with the channel 110. Thus, hot water heated by the vessel 20 is induced to move through the channels 110 located in the respective side frames 100 and out the outlets 22B and through the flexible outlet line 22A to the holding tank 14.

Because vessel 20 moves back and forth on base 50, it is appreciated that the water inlet and outlet lines directly coupled to the vessel 20 should preferably be flexible. To accommodate the flexible pipes extending to and from the back portion of the vessel 20, there is provided a series of pipe racks or holders 250 that project outwardly from the walls 60 and 62 that form the base. See FIGS. 2 and 3. Note that the flexible pipe supports 250 are disposed about a rear portion of the respective walls 60 and 62.

The size of the vessel 20 and holding tank 14 can vary depending upon need and application. For example, in the case where the hot water heating system 10 of the present invention is utilized to supply heat to tobacco barns, the vessel 20 was configured to hold approximately 19,000 gallons of water, while the holding tank was configured to hold approximately 100,000 gallons of water. The various pumps utilized to pump water back and forth between the vessel 20 and the holding tank 14 can be sized to pump approximately 700 gallons per minute of water. It is appreciated that the head pressure of the water in the vessel 20 would aid in pumping the water from the vessel 20 to the holding tank. Furthermore, the head pressure in the holding tank 14 would aid in pumping the water from the holding tank 14 to the various structures 16.

The temperature of the water can vary, depending upon design, the outside temperature, the particular application, and other variables. However, it is contemplated that in one embodiment, that the temperature of the water being pumped from the vessel 20 to the holding tank would be approximately 200° F.-210° F. The water being returned from the holding tank 14 to the vessel 20 would typically be approximately 180° F. The temperature of the water reaching the various heat exchangers 40, as shown in FIG. 1, would typically be approximately 200° F.-205° F.

Various solid fuels can be used in the fire chamber 52. However, it is contemplated that one efficient fuel that is particularly useful in rural or agricultural areas for carrying or drying tobacco, or heating greenhouses for example, would be wood. Typically the fire chamber 52 would be designed to hold a sufficient quantity of wood to burn 15 to 24 hours before requiring the fire chamber 52 to be reloaded.

In use, in the case of utilizing wood as a solid fuel, the operator of the hot water heating system 10 of the present invention would have one or more pieces of heavy equipment available to load the wood into the fire chamber 52. This same heavy equipment could be utilized to push or move the vessel back and forth between the heating position and the loading position. As illustrated in FIG. 2, the vessel 20 is provided with a push bar 260 that projects laterally from the side of the vessel 20. This push bar 260 can be engaged with a front end loader or other piece of heavy equipment to move the vessel 20 back and forth between the heating position and the loading position.

It is appreciated that when the vessel 20 assumes the loading position and the fire chamber 52 is loaded and burning, that the fire chamber 52 is substantially sealed by the vessel 20, side walls 60, 62 and 64, and the front door 66. However, it is appreciated that the interface between the vessel 20 and the walls 62 and 64 and the front door 66 would not provide a perfect air tight seal and that some air may be induced into the fire chamber at these interfaces. As discussed above, the design disclosed herein encourages air to be induced through the interfaces where the rollers 220 are located.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A hot water heating system, comprising:

a. a base;

b. a vessel for holding water and supported on the base;

c. the vessel being movable back and forth on the base between a heating position and a loading position;

d. a fire chamber disposed under the vessel when the vessel assumes the heating position;

e. wherein when the vessel assumes the loading position the fire chamber includes an open top for permitting solid fuel, such as wood, to be loaded into the fire chamber; and f. a plurality of rollers for permitting the vessel to move back and forth between the heating position and the loading position.

2. The hot water heating system of claim 1 wherein the base includes two spaced apart supports and wherein the fire chamber is disposed between the spaced apart supports, and wherein the vessel extends from one support to the other support and spans the fire chamber.

3. The hot water heating system of claim 1 wherein the vessel includes an arcuate shaped bottom that faces the fire chamber.

4. The hot water heating system of claim 3 wherein the bottom of the vessel assumes a concave shape.

5. The hot water heating system of claim 1 wherein the vessel includes a bottom and a top and wherein the vessel includes a series of spaced apart trusses that are disposed interiorly of the vessel.

6. The hot water heating system of claim 1 wherein the vessel includes one or more exhaust tubes that extend through an interior area of the vessel.

7. The hot water heating system of claim 1 wherein the vessel includes a bottom and a top and wherein there is provided a plurality of exhaust tubes that extend from the bottom of the vessel, through an interior area of the vessel, and to the top of the vessel such that exhaust gas from the fire chamber can be exhausted through the exhaust tubes.

8. The hot water heating system of claim 1 including a flexible hot water outlet line communicatively coupled to the vessel for permitting hot water to flow from the vessel.

9. The hot water heating system of claim 1 including one or more openable doors that are disposed adjacent the fire chamber and which when closed, close a portion of the fire chamber.

10. The hot water heating system of claim 9 wherein the base includes a pair of spaced apart sidewalls that support the vessel and wherein the one or more open doors is disposed at one end of the hot water heating system and extend generally between the two walls.

11. The hot water heating system of claim 9 wherein the one or more openable doors include a water jacket for holding water.

12. The hot water heating system of claim 1 wherein the vessel includes a bottom, and wherein there is provided an array of wet tubes extending from the bottom.

13. The hot water heating system of claim 12 including one or more exhaust tubes that extend through the vessel.

14. The hot water heating system of claim 1 including a holding tank; at least one water outlet line extending from the vessel to the holding tank for channeling water from the vessel to the holding tank; and at least one return line extending between the holding tank and the vessel for returning water from the holding tank to the vessel.

15. The hot water heating system of claim 1 including one or more heat exchangers; a hot water distribution network for directing hot water from the vessel to the one or more heat exchangers; and wherein the heat exchangers heat one or more structures.

16. The hot water heating system of claim 15 including a holding tank for holding hot water produced by the vessel and wherein the one or more heat exchangers are served by the holding tank.

17. The hot water heating system of claim 1 including one or more tobacco barns and one or more hot water lines leading to the one or more tobacco barns for directing hot water produced by the vessel to the one or more tobacco barns for use to heat the one or more tobacco barns.

18. A hot water heating system, comprising:

a. a base;

b. a vessel for holding water and supported on the base;

c. the vessel being movable back and forth on the base between a heating position and a loading position;

d. a fire chamber disposed under the vessel when the vessel assumes the heating position;

e. wherein when the vessel assumes the loading position the fire chamber includes an open top for permitting solid fuel, such as wood, to be loaded into the fire chamber; and f. wherein the vessel includes a bottom and a top and wherein the vessel includes a series of spaced apart trusses that are disposed interiorly of the vessel.

19. A hot water heating system, comprising:

a. a base;

b. a vessel for holding water and supported on the base;

c. the vessel being movable back and forth on the base between a heating position and a loading position;

d. a fire chamber disposed under the vessel when the vessel assumes the heating position;

e. wherein when the vessel assumes the loading position the fire chamber includes an open top for permitting solid fuel, such as wood, to be loaded into the fire chamber; and f. wherein the vessel includes one or more exhaust tubes that extend through an interior area of the vessel.

20. A hot water heating system, comprising:

a. a base;

b. a vessel for holding water and supported on the base;

c. the vessel being movable back and forth on the base between a heating position and a loading position;

d. a fire chamber disposed under the vessel when the vessel assumes the heating position;

e. wherein when the vessel assumes the loading position the fire chamber includes an open top for permitting solid fuel, such as wood, to be loaded into the fire chamber; and f. including a flexible hot water outlet line communicatively coupled to the vessel for permitting hot water to flow from the vessel.

21. A hot water heating system, comprising:

a. a base;

b. a vessel for holding water and supported on the base;

c. the vessel being movable back and forth on the base between a heating position and a loading position;

d. a fire chamber disposed under the vessel when the vessel assumes the heating position;

e. wherein when the vessel assumes the loading position the fire chamber includes an open top for permitting solid fuel, such as wood, to be loaded into the fire chamber; and f. wherein the vessel includes a bottom, and wherein there is provided an array of wet tubes extending from the bottom.

22. A hot water heating system, comprising:

a. a base;

b. a vessel for holding water and supported on the base;

c. the vessel being movable back and forth on the base between a heating position and a loading position;

d. a fire chamber disposed under the vessel when the vessel assumes the heating position;

e. wherein when the vessel assumes the loading position the fire chamber includes an open top for permitting solid fuel, such as wood, to be loaded into the fire chamber; and f. including one or more tobacco barns and one or more hot water lines leading to the one or more tobacco barns for directing hot water produced by the vessel to the one or more tobacco barns for use to heat the one or more tobacco barns.

* * * * *